United States Patent [19]

Brockman et al.

[11] 4,109,980

[45] Aug. 29, 1978

[54] HOME BATTERY STORAGE AND DISPENSER

[76] Inventors: Gary Brockman; Hubert J. McFadden; George Spector, all c/o George Spector, 3615 Woolworth Bldg., 233 Broadway, New York, N.Y. 10007

[21] Appl. No.: 698,074

[22] Filed: Jun. 21, 1976

[51] Int. Cl.[2] ..... A47F 1/00

[52] U.S. Cl. ..... 312/35; 312/45; 211/49 R; 312/245

[58] Field of Search ..... 312/31–91, 312/245; 211/49, 60

[56] References Cited

U.S. PATENT DOCUMENTS

| | | | |
|---|---|---|---|
| 2,089,999 | 8/1937 | Greene | 312/223 X |
| 2,147,086 | 2/1939 | Bryant | 312/42 |
| 2,299,027 | 10/1942 | Novak | 312/45 X |
| 2,692,053 | 10/1954 | Calhoun et al. | 312/45 |
| 2,868,603 | 1/1959 | Wilkinson | 312/72 UX |
| 3,574,528 | 4/1971 | Siano | 312/45 |
| 3,948,417 | 4/1976 | McCain | 312/45 |

*Primary Examiner*—Casmir A. Nunberg
*Assistant Examiner*—Victor N. Sakran

[57] ABSTRACT

A rack mountable on a wall, the rack having compartments formed on its front side, the compartments being of different sizes so that each is suitable for containing a particular size of dry cell batteries that are stored therein. This rack can also be placed on a shelf, counter or refrigerator top.

1 Claim, 5 Drawing Figures

HOME BATTERY STORAGE AND DISPENSER

This invention relates generally to storage racks.

A principal object of the present invention is to provide a storage rack for holding dry cell batteries, thus providing a station to which a person can go to meet all his battery requirements when needing to replace a worn out battery such as in a flashlight, radio or any other battery-operated appliance used in a home.

Another object is to provide a home battery storage rack which accordingly provides for the storage of various different sizes of batteries so to suit all appliances.

Yet another object is to provide a home battery storage from which the batteries can be easily dispensed.

Other objects are to provide a home battery storage and dispenser which is simple in design, inexpensive to manufacture, rugged in construction, easy to use and efficient in operation.

These and other objects will be readily apparent upon a study of the following specification and the accompanying drawing wherein.

Figure 1:
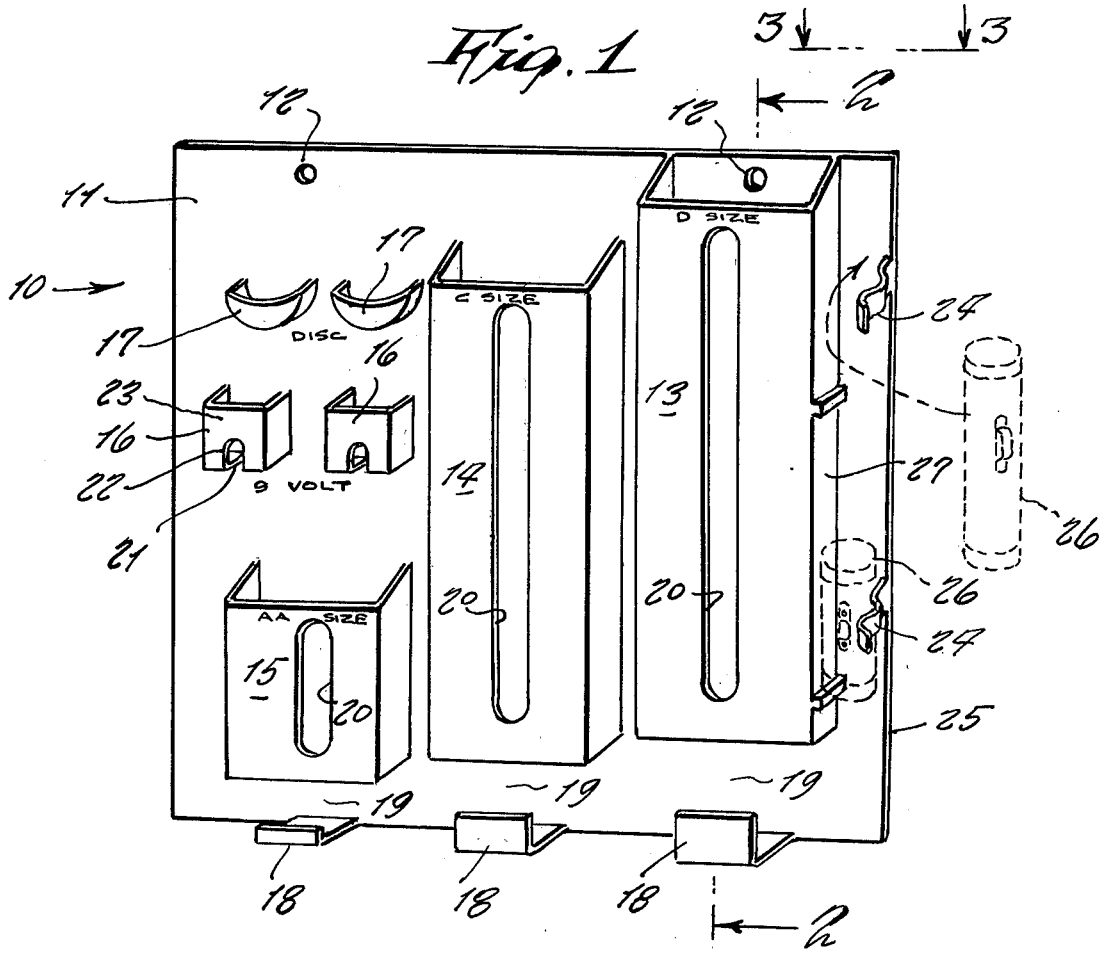
FIG. 1 is a front perspective view of the invention.
Figure 2:
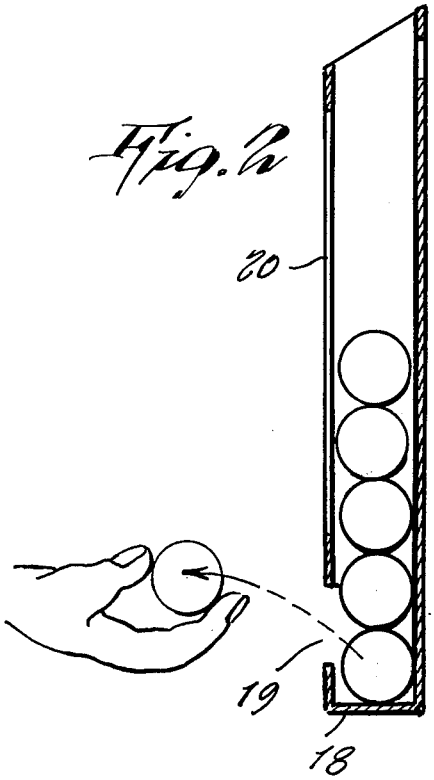
FIG. 2 is a cross sectional view taken on line 2-2 of FIG. 1.
Figure 3:
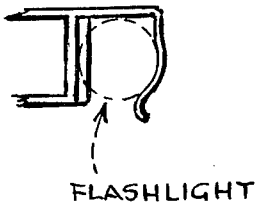
FIG. 3 is a view in direction 3—3 of FIG. 1 and showing the flashlight supporting clip and ledge.

Referring now to the drawing in detail, and more particularly to FIGS. 1 through 3 at this time, the reference numeral 10 represents a home battery storage and dispenser according to the present invention wherein the same is molded of one piece plastic and includes a flat back panel 11 having mounting openings 12 for receiving securement means to a vertical wall. Upon a front side of the back panel there are formed a plurality of compartments each of a different size and each being suitable for storing a different particular size of batteries.

Thus a compartment 13 serves to hold D size batteries, a compartment 14 holds C size batteries, a compartment 15 holds AA size batteries, two compartments 16 hold 9 volt batteries, and two compartments 17 hold disc batteries.

The compartments 13, 14 and 15 are each tubular in shape extending vertically and being open at top and bottom. A forward extending, hook-shaped lug 18 formed a spaced distance below the lower end of each of these compartments serves as a stop plate upon which the lowermost battery rests, with a stack of other like size batteries resting therabove one upon another. A space 19 thus formed between the lug and the bottom of the compartment permits the lowermost battery to be extracted from the compartment, as shown in FIG. 2. A long vertical slot 20 through a front wall of the compartment allows a person to readily see how many batteries are left inside the compartment, so he is aware when he must restock the compartment with a new supply of batteries.

The compartments 16, which holds smaller batteries, are shallower and according include a bottom wall 21 and a notch 22 at a lower front edge of the bottom wall and which extends upwardly on the front wall 23 so that a person can insert a finger therein and push the stack of batteries upward so to remove one from the opened top of the compartment.

The compartments 17 comprise a semi-circular tray in which circular disc shaped batteries are stored in vertical upright position.

A pair of spring clips 24 are formed along one side edge 25 of the back panel and each serves to hold a flashlight 26 between the clip and a side wall 27 of the compartment 13.

Figure 4:
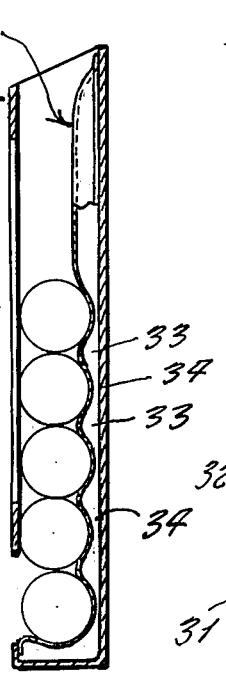
FIG. 4 is a view similar to FIG. 2 and shown a modified design thereof which includes a flexible rubber film on an inner rear side of the battery receptacle so to form a pneumatic cushion that allows the batteries to be gently lowered instead of violently dropped; it having been proven that rough shock depletes battery charge quicker.
Figure 5:
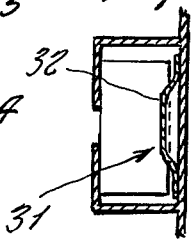
FIG. 5 is a cross sectional view on line 5—5 of FIG. 4.

Reference is now made to FIGS. 4 and 5 wherein a modified design of hom battery storage and dispenser 30 is exactly the same as the above described home battery storage and dispenser 10 except that it additionally includes a pneumatic cushion 31 for use particularly in compartments 13, 14 and 15 and which allows the batteries to be gently lowered inside the compartment when a lowermost one is removed, thus preventing a sudden drop and shock thereto. The cushion comprises a flat film of rubber shaped into a vertical strip 32. It is placed inside the compartment against the back panel and against the top of the lug, and the entire edge of the strip is adhered by a suitable cement to the plastic surface of the back wall and lug so to prevent any air leakage therebetween. The cushion thus formed, is inflated with air.

In use, as the batteries rest inside the compartment, a small air cell 33 is thus formed in the cushion between each battery. When a lowermost battery is removed, the batteries thereabove then are slowly lowered due to the air in each air cell being squeezed upwardly into an adjacent upper air cell through a narrow air space or passage 34 formed where the battery squeezes the cushion very close to the back panel. The newly lowermost battery drops down upon the lower end of the cushion which catches it without shock, the cushion being L-shaped.

Thus a modified design is provided.

While various changes may be made in the detail construction it is understood that such changes will be within the spirit and scope of the present invention as is defined by the appended claims.

What is claimed is:

1. In a home battery storgae dispenser, the combination of an intergral flat panel with a plurality of compartments projecting from a front side of said panel, said compartments being of different sizes for holding a plurality of varying sized and shaped batteries, said compartments having top openings and means at the bottom to support the bottom battery, wherein certain of said compartments are tubular with rectangular cross-section, said means comprising a forward extending lug vertically spaced from and aligned with said compartment forming a battery stop and rest, a front side of said compartment having a vertical slot for viewing batteries in said compartment, wherein other of said comparements include a bottom wall with finger receiving opening to push said batteries upward and out a top opening, and still other compartments are semi-circular in shape, further including clips are formed on a side edge of said panel spaced laterally from a compartment for holding flashlights therebetween and a side of one said compartments provided with vertically spaced cleats to support the bottom of said flashlights wherein pneumatic cushion is provided longitudinally on said compartments having rectangular cross-section, said cushion comprising a vertical flexible strip of material sealingly mounted on said rear wall having a front portion spaced from said panel for engaging said batteries the full length of said compartment, including a lowermost portion of said strip sealingly attached to said lug forming an L-shaped bottom cushion to receive the lowermost battery, wherein said batteries are resiliently engaged by a front wall of the compartment and said cushion.

* * * * *